US012433353B2

(12) United States Patent
Karas et al.

(10) Patent No.: US 12,433,353 B2
(45) Date of Patent: Oct. 7, 2025

(54) PROTECTIVE BLAZER FOR MOTORCYCLISTS

(71) Applicants: Nino Karas, Skopje (MK); Nina Levikj, Skopje (MK)

(72) Inventors: Nino Karas, Skopje (MK); Nina Levikj, Skopje (MK)

( * ) Notice: Subject to any disclaimer, the term of this patent is extended or adjusted under 35 U.S.C. 154(b) by 397 days.

(21) Appl. No.: 17/709,179

(22) Filed: Mar. 30, 2022

(65) Prior Publication Data

US 2022/0322761 A1 Oct. 13, 2022

Related U.S. Application Data

(60) Provisional application No. 63/168,189, filed on Mar. 30, 2021.

(51) Int. Cl.
*A41D 13/015* (2006.01)
*A41D 1/02* (2006.01)

(52) U.S. Cl.
CPC ..... *A41D 13/0158* (2013.01); *A41D 1/02* (2013.01); *A41D 13/015* (2013.01); *A41D 2600/102* (2013.01)

(58) Field of Classification Search
None
See application file for complete search history.

(56) References Cited

U.S. PATENT DOCUMENTS

| | | | | | |
|---|---|---|---|---|---|
| 2,582,772 | A * | 1/1952 | Egbert | A41D 15/00 | 2/95 |
| 4,722,099 | A * | 2/1988 | Kratz | A41D 27/28 | 2/93 |
| 4,864,656 | A * | 9/1989 | Nesse | A41D 27/04 | 441/106 |
| 4,999,850 | A * | 3/1991 | Grilliot | A41D 27/04 | 2/93 |
| 5,611,084 | A * | 3/1997 | Garry | A61F 5/028 | 2/93 |
| 5,810,699 | A * | 9/1998 | Nadeau | A63B 21/065 | 2/102 |
| 5,864,879 | A * | 2/1999 | Bercane | A41D 1/02 | 2/93 |
| 5,933,865 | A * | 8/1999 | Aldridge | A62B 17/003 | 2/81 |
| 6,260,196 | B1 * | 7/2001 | van der Sleesen | A41D 27/28 | 2/2.5 |
| 6,263,509 | B1 * | 7/2001 | Bowen | A41D 13/05 | 2/84 |
| 6,519,781 | B1 * | 2/2003 | Berns | A41D 13/0153 | 2/455 |
| 8,528,112 | B2 * | 9/2013 | Blauer | F41H 1/02 | 2/92 |
| 10,111,480 | B2 * | 10/2018 | Pezzimenti | A41D 31/065 | |
| 2002/0069453 | A1 * | 6/2002 | Kelleher | A62B 17/003 | 2/458 |

(Continued)

*Primary Examiner* — Jocelyn Bravo
(74) *Attorney, Agent, or Firm* — Arman Khosraviani

(57) ABSTRACT

Some embodiments provide a protective motorcycle blazer for protecting a motorcyclist. The protective motorcycle blazer includes an outer layer comprising textile fabric for providing an appearance of a blazer, a middle layer comprising abrasion resistant material for providing abrasion resistance to the protective motorcycle blazer, and an inner layer for providing an interface between the motorcyclist and the protective motorcycle blazer.

20 Claims, 6 Drawing Sheets

(56) References Cited

U.S. PATENT DOCUMENTS

| | | | | |
|---|---|---|---|---|
| 2002/0174476 | A1* | 11/2002 | Cochran | A62B 17/003 2/97 |
| 2006/0162041 | A1* | 7/2006 | Tengbom | A41F 5/00 2/85 |
| 2006/0277647 | A1* | 12/2006 | Dobkin | A41D 13/05 2/69 |
| 2008/0040832 | A1* | 2/2008 | Bay | A41D 27/28 2/93 |
| 2008/0216206 | A1* | 9/2008 | Mazzarolo | A41D 3/00 2/243.1 |
| 2009/0077710 | A1* | 3/2009 | Bay | A41D 3/00 2/243.1 |
| 2012/0174298 | A1* | 7/2012 | Bay | A41D 31/00 2/463 |
| 2013/0318671 | A1* | 12/2013 | Haider | F41H 1/02 2/2.5 |
| 2014/0304900 | A1* | 10/2014 | Sugano | A41D 13/0575 2/455 |

* cited by examiner

PROTECTIVE BLAZER FOR MOTORCYCLISTS

RELATED APPLICATIONS

The present application is a non-provisional application claiming the benefit of U.S. Provisional Application No. 63/168,189, filed Mar. 30, 2021, entitled "Protective Blazer for Motorcyclists," the entirety of which is incorporated herein by reference.

FIELD OF THE INVENTION

The present invention relates to protective clothing meant for motorcycle riders, and more particularly, to a new type of motorcycle gear, that looks like a blazer from the outside, but has abrasion resistance and impact protection to satisfy safety standards.

BACKGROUND

Motorcycle protective gear is motorcycle equipment that satisfies the required standards for the riders' protection when riding a motorcycle.

Different countries and regions have different safety standards and thus different requirements. However, there are three general categories of requirements that the protective motorcycle clothing needs to meet: abrasion resistance, impact protection, and comfort.

Motorcycle riding clothes for upper body-protection, or widely known as motorcycle jackets, are usually produced out of abrasion-resistant textile fabric or leather. Additionally, impact protectors are incorporated in the shoulder, elbow and the back areas, to prevent injuries in case of an accident.

Even though many manufacturers produce different types and styles of motorcycle jackets that satisfy different safety standards, none of them satisfies nor can be classified as an elegant clothing item.

This presents a problem for many motorcycle riders in the world for whom the motorcycle is the primary mode of transportation. Many of them work in an office environment and have many meetings and events throughout the day that require a business dress code. They can either wear motorcycle gear that doesn't satisfy the business attire and stay safe, or wear suits and blazers to satisfy the desired business look, but ride unprotected risking their health and wellbeing.

Therefore, what is needed is a new type of motorcycle garment for upper body-protection that has a look and form of an elegant blazer to satisfy the business attire, while at the same time has all of the protective properties to satisfy the widely accepted safety standards.

SUMMARY

Figure 1:
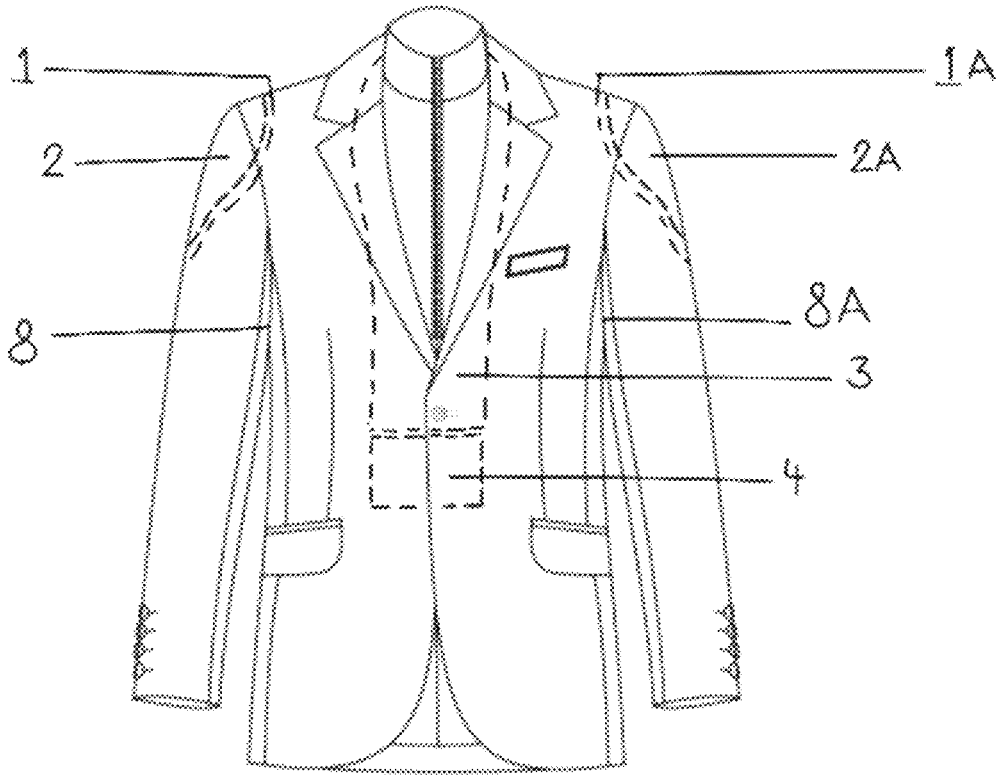
FIG. 1 illustrates a front view of one example of the motorcycle blazer according to various embodiments of the present invention.
Figure 2:
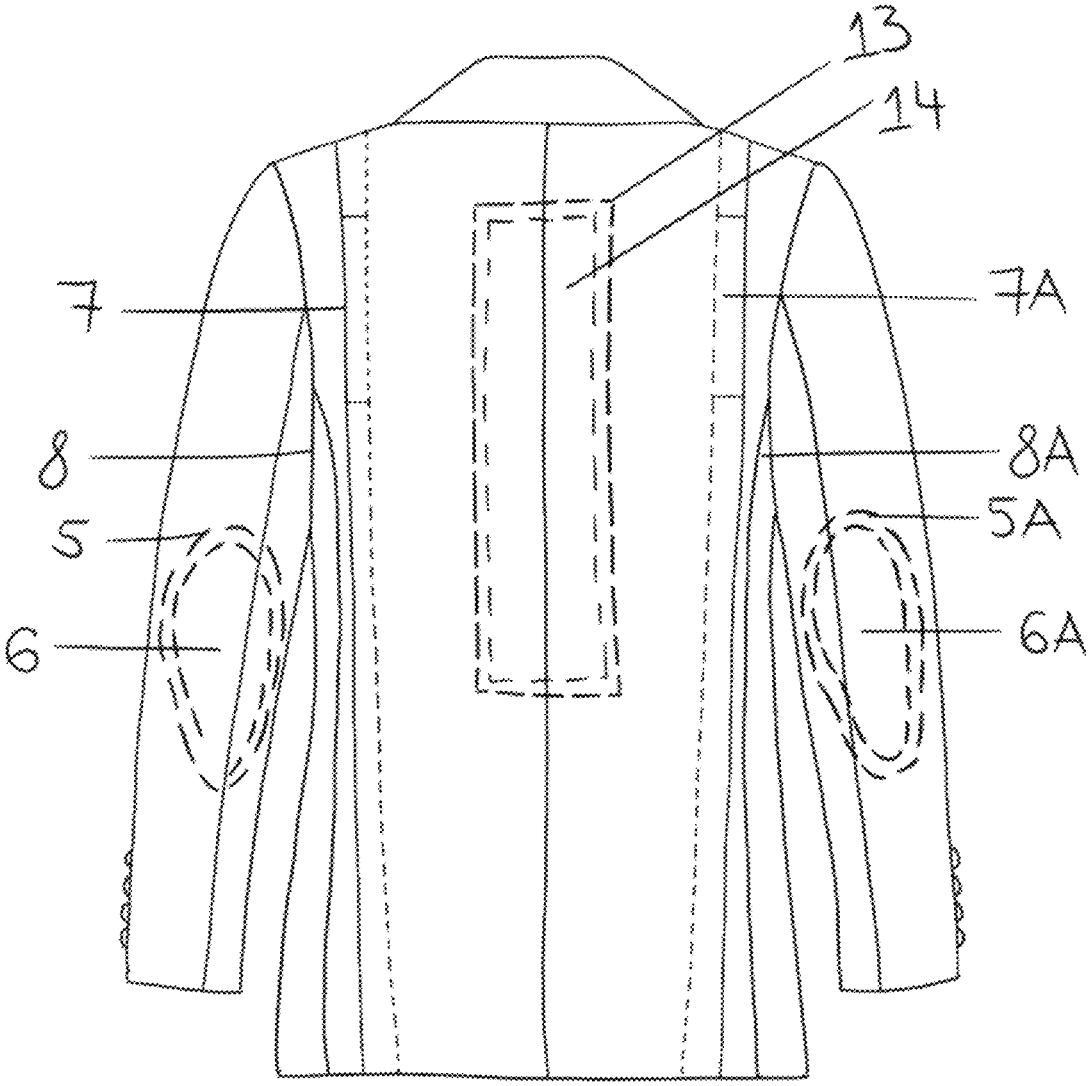
FIG. 2 depicts a back view of one example of the motorcycle blazer according to various embodiments described herein.
Figure 3:
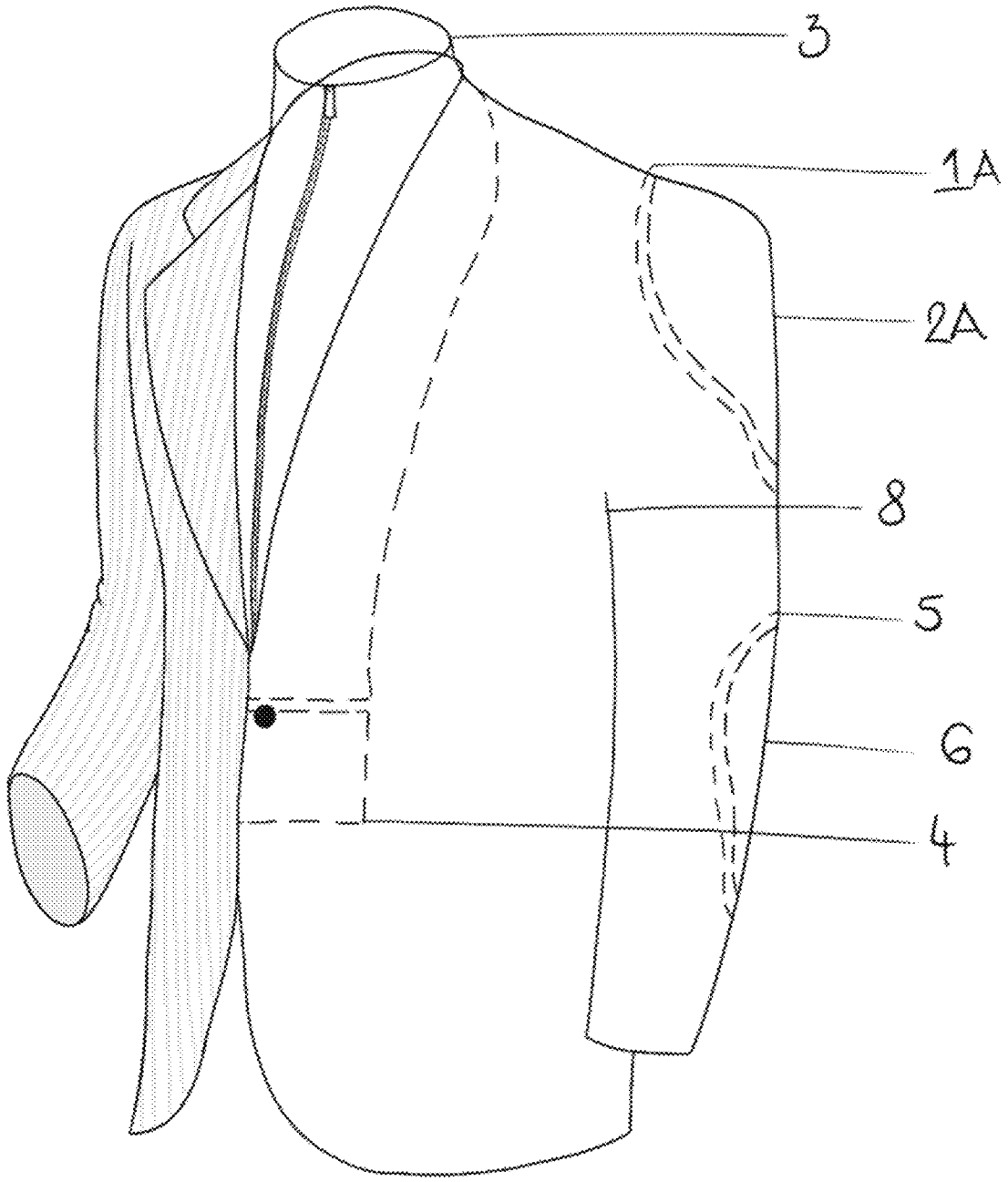
FIG. 3 shows a perspective view of one example of the motorcycle blazer according to various embodiments of the present invention.

The present invention seeks to provide a solution to this problem by providing a blazer meant for motorcyclists; as an elegant clothing item with protection and comfort properties that satisfy all the requirements of the widely accepted safety standards for the production of motorcycle gear.

The present invention is composed of, but not limited to three layers of material: an outer layer that consists of a textile fabric, a main, middle layer that is an abrasion-resistant material, and a third layer that consists of the lining. Impact protectors are incorporated on the shoulder, elbow and back areas to prevent injuries in case of an accident. In some embodiments, the main, middle layer provides a frame for the rest of the protective blazer because it is comprised of rigid material. Special shoulder gussets are incorporated to provide great ergonomics and comfort when riding a motorcycle. A ventilation system is integrated as mesh panels located on the armpits that cut through the three main layers of fabrics to enable air circulation within the blazer.

Certain embodiments to the present invention include, but are not limited to:

a) Removable gilet that covers the chest and neck area of the body and provides wind protection when riding a motorcycle.

b) Impact protector pocket and back impact protector located on the back area of the blazer.

In one embodiment, a protective motorcycle blazer for protecting a motorcyclist is provided. The protective motorcycle blazer includes: an outer layer comprising textile fabric for providing an appearance of a blazer; a middle layer comprising abrasion resistant material for providing abrasion resistance to the protective motorcycle blazer; and an inner layer for providing an interface between the motorcyclist and the protective motorcycle blazer.

In another embodiments, a motorcycle jacket is provided. The motorcycle jacket includes: an outer blazer component made of textile fabric, the outer blazer component including: a left breast panel and a right breast panel, and a first fastening mechanism for securing the left breast panel and the right breast panel together across a torso of a user of the motorcycle jacket; an inner abrasion resistant component made from abrasion resistant material that is secured to the outer blazer component, the middle abrasion resistant component providing a frame for the motorcycle jacket; and a second fastening mechanism internal to the first fastening mechanism that attaches to the frame of the motorcycle jacket and fastens across the torso of the user, wherein the second fastening mechanism prevents displacement of the motorcycle jacket during an abrasion event, wherein the lower torso fastening mechanism is comprised of abrasion resistant material and attached to the middle layer.

These and other aspects of the present invention will become apparent to those skilled in motorcycle protective gear after a reading of the following description of the preferred embodiments when considered in conjunction with the drawings. It should be understood that both the foregoing general description and the following detailed description are exemplary only and are not restrictive of the invention as claimed.

DETAILED DESCRIPTION

In the following description, for purposes of explanation, numerous examples and specific details are set forth in order to provide a thorough understanding of the present disclosure. It will be evident, however, to one skilled in the art that various embodiment of the present disclosure as defined by the claims may include some or all of the features in these examples alone or in combination with other features described below, and may further include modifications and equivalents of the features and concepts described herein.

The terminology used herein is for the purpose of describing particular embodiments only and is not intended to be limiting the invention. As used herein, the term "and/or" includes any and all combinations of one or more of the associated listed items. As used herein, the singular forms "a", "an", and "the" are intended to include the plural forms as well as the singular forms, unless the context clearly indicates otherwise.

The present disclosure is to be considered as an exemplification of the invention and is not intended to limit the invention to the specific embodiments illustrated by the figures or description below.

The present disclosure provides a blazer meant for motorcyclists, with protection and comfort properties that satisfy all the requirements of the widely accepted safety standards for the production of motorcycle gear. The present invention has the look of a blazer from the outside satisfying the need for elegant motorcycle apparel.

Figure 6:
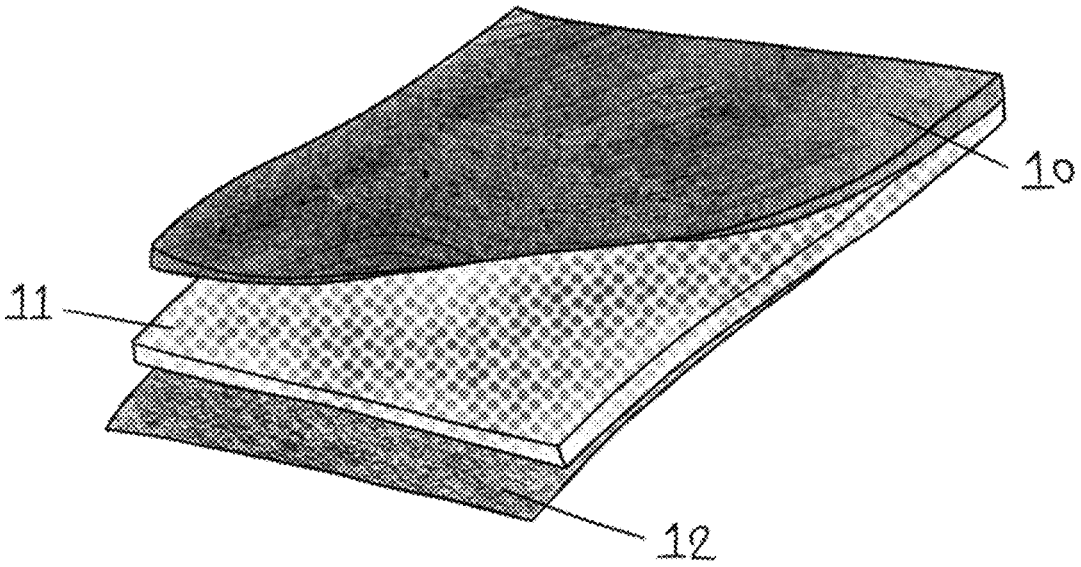
FIG. 6 depicts an example of the three-layered structure of fabrics used in the present invention.

The present invention is composed of, but not limited to three layers of fabrics as perhaps best shown in FIG. 6: an outer layer that consists of a textile fabric 10, the main layer that is an abrasion-resistant material 11, and a third layer that consists of the lining 12.

Preferably, the first layer of the motorcycle blazer is a textile fabric 10 which is generally used for the production of suits and blazers. This fabric defines the look of the blazer, allowing it to have different colors and styles, depending on the particular design. This layer is optional and in certain embodiments of the present innovation, this layer may be omitted. In some embodiments, the first layer presents an appearance of a blazer and may include, for example, a lapel, an open chest and neck area, left and right breast panels, long sleeves, a breast pocket, a button fastening mechanism to fasten the left and right breast panels, a front dart, a collar, a roll line, a sleeve vent, a pocket flap, and the like.

Under this fabric, the motorcycle blazer is reinforced with an abrasion-resistant material 11 that represents the main layer of the disclosure. In preferred embodiments, this protective fabric 11 is a special blend of materials that incorporate strong synthetic aramid and para-aramid fibers. This makes the motorcycle blazer highly abrasion-resistant, preventing harm to the rider's skin during a slide in an accident.

Preferably, the third layer of the invention consists of the lining 12. This layer provides a soft feeling on the skin and an elegant look of the disclosure from the inside.

Referring now to FIG. 1-4, on the shoulder and elbow areas of the motorcycle blazer, pockets for impact protectors are sewed as part of the lining 12. This includes the right shoulder impact protector pocket 1, left shoulder impact protector pocket 1A, left elbow impact pocket 5, right elbow impact protector pocket 5A and back impact protector pocket 13. Within these pockets, right shoulder impact protector 2, left shoulder impact protector 2A, left elbow impact protector 6, right elbow impact protector 6A, and back impact protector 14 are incorporated accordingly. The impact protectors represent additional protection to the disclosure since they provide the required impact protection to the rider in order to prevent injuries and bone fractures in case of an accident.

Figure 4:
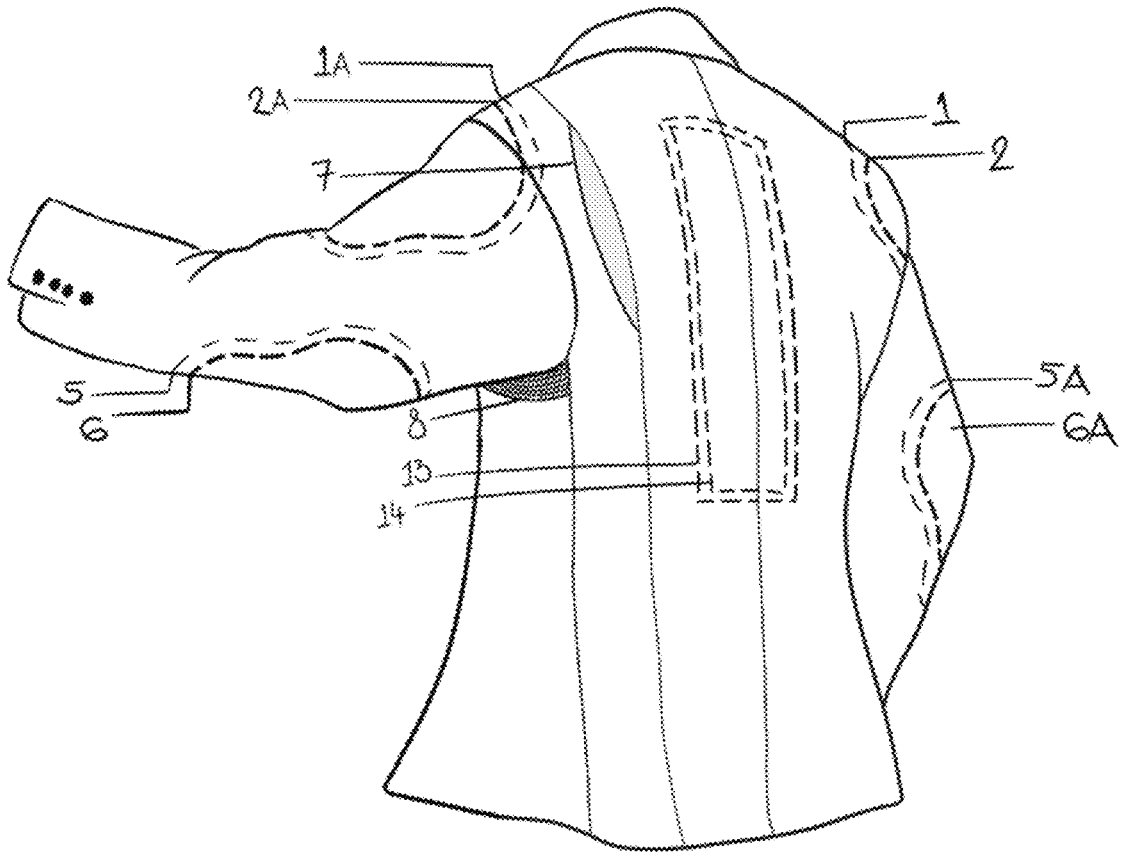
FIG. 4 depicts an example of a side view of the motorcycle blazer in a riding position, with the arm raised and gusset expanded according to various embodiments described herein.

The invention is designed to enable great ergonomics and comfort while riding. Since motorcycles come in many different forms, the riding position of the body differs from upright to fully leaned forward. This challenges the classic blazer design as it limits certain body movements. That is why, the motorcycle blazer has special shoulder gussets, left shoulder gusset 7, and right shoulder gusset 7A, at the back of the disclosure. FIG. 4 illustrates how the gussets expand as the rider leans and stretches the arms forward. This enables free movement of the arms and stretching of the rider's back to provide comfort in every riding position.

As perhaps best shown in FIG. 4, a ventilation system is incorporated under the armpit of the rider. It consists of mesh panels located on the armpits—left armpit ventilation mesh 8 and right armpit ventilation mesh 8A. These mesh panels cut through the three main layers of fabrics to enable air circulation within the blazer, making the ride more pleasant even on warmer and sunnier days.

Figure 5:
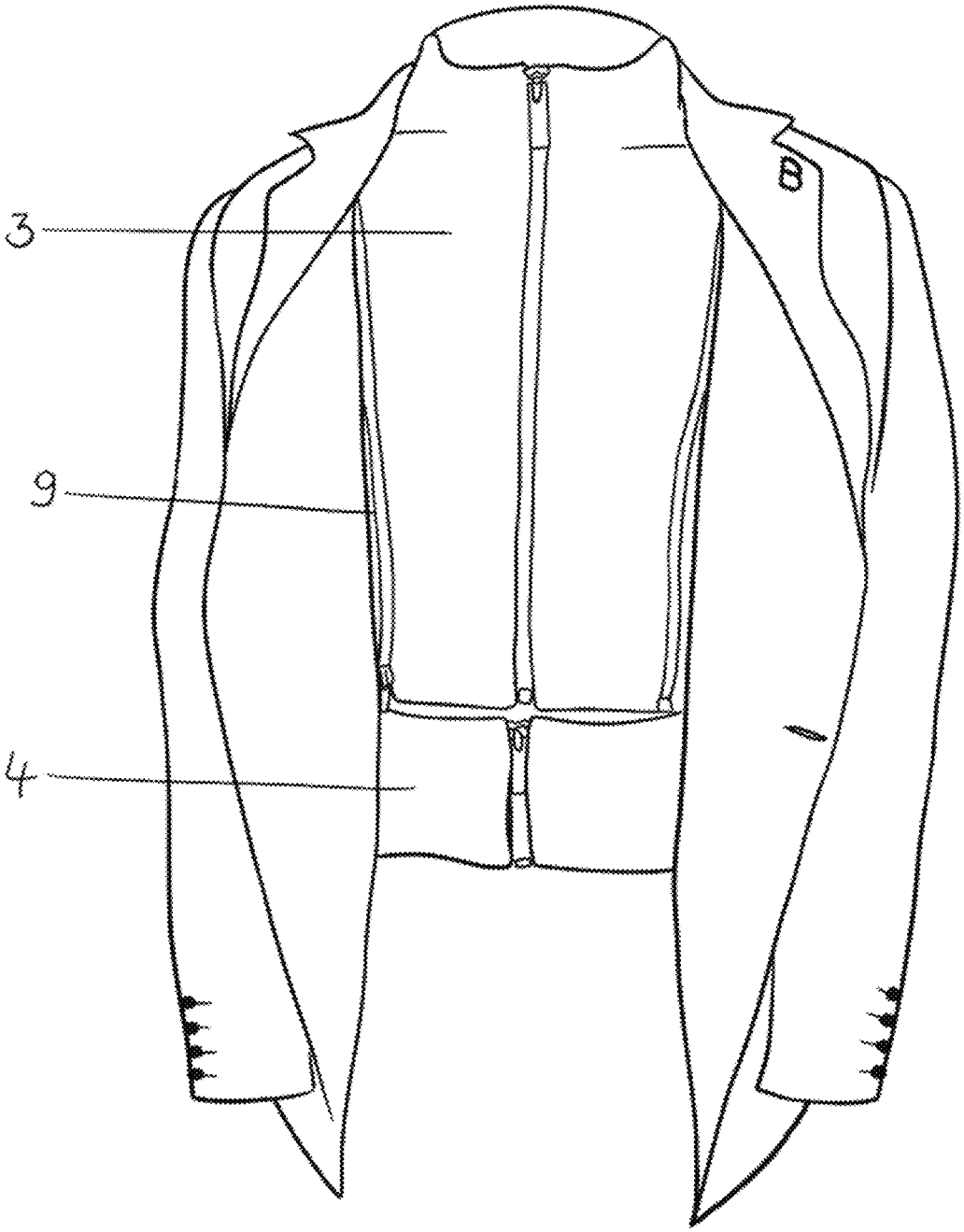
FIG. 5 illustrates an example of a front view of the motorcycle blazer in an unbuttoned state showing the removable gilet and novel fastening mechanism.

Referring now to FIG. 5, a novel fastening mechanism 4 is incorporated to prevent loss of the motorcycle blazer from the rider's body during a slide or other abrasion event. This fastening mechanism is directly connected to the main layer 11 to provide structural strength and to ensure that the motorcycle blazer stays on to protect the body of the motorcyclist in case of an accident.

In preferred embodiments, the motorcycle blazer incorporates a removable windproof gilet 3, that covers the usually open chest and neck area. While riding, the upper body of the motorcyclist is constantly exposed to a colder wind, which in lower temperatures can lead to loss of concentration, slowed reaction, and even hypothermia. To prevent this from happening, the windproof gilet 3 provides the required wind protection so that even on colder days the rider can stay warm and focused on the road ahead. As perhaps best shown in FIG. 5, the windproof gilet 3 is connected to the motorcycle blazer with a detachable zipper 9, allowing the rider to easily remove the gilet based on the occasion. Additionally, this windproof gilet is reinforced with the same protective fabric used in the main layer 11, providing additional protection to this area of the disclosure.

While preferred layers and materials have been described, the motorcycle blazer is not limited by these layers and materials.

The invention has been described herein in terms of preferred embodiments and methodologies considered by the inventors to represent the best mode of carrying out the invention. It will be understood by a skilled person in the field of motorcycle protective gear that a wide range of additions, deletions, and modifications, both subtle and gross, may be made to the illustrated and exemplary embodiments without departing from the spirit and scope of the invention. These and other revisions might be made by those with skill in the field of motorcycle protective gear without departing from the spirit and scope of the invention.

What is claimed is:

1. A protective blazer for protecting a motorcyclist, comprising:

an outer layer comprising fabric configured for providing an appearance of a blazer;

an inner layer, the inner layer configured to provide an interface between a wearer and the protective blazer;

a middle layer comprising abrasion resistant material, the middle layer forming a frame of the protective blazer and being located between the inner layer and the outer layer;

the middle layer securing to and covering the outer layer of the protective blazer with abrasion resistant material to reinforce the outer layer and protect the skin and torso of the wearer in a slide event or abrasion event during an accident;

at least one pocket sewn on and formed along a part of the inner layer adjacent to the wearer, the at least one pocket configured to include an impact protector; and a fastening mechanism comprising abrasion resistant material, the fastening mechanism being directly attached to the middle layer and extending from the middle layer and a front left side of the protective blazer and from the middle layer and a front right side of the protective blazer.

2. The protective blazer of claim 1, wherein the at least one pocket comprises a first pair of pockets and a second pair of pockets, each pocket of the first pair of pockets being located in respective left and right shoulder areas of the protective blazer and integrated with a shoulder impact protector, and each pocket of the second pair of pockets being located in respective left and right elbow areas of the protective blazer and integrated with an elbow impact protector.

3. The protective blazer of claim 1, further comprising a pair of mesh panels, each mesh panel of the pair of mesh panels located at or near an armpit region of the protective blazer for providing ventilation to the wearer, wherein the middle layer extends across both armpit regions of the protective blazer, and the pair of mesh panels cut through each of the outer, middle, and inner layers.

4. The protective blazer of claim 1, further comprising a pair of gussets disposed between a pair of shoulder panels of the protective blazer, each gusset of the pair of gussets comprising textile fabric folded on top of itself and expandable for enabling freedom of movement of the arms of the wearer and configured to extend along a back of the protective blazer.

5. The protective blazer of claim 1, wherein the fastening mechanism attaches to a lower torso of the frame of the protective blazer, and the fastening mechanism is configured to separate a left lower torso side of a front of the protective blazer from a right lower torso side of the front of the protective blazer when unfastened, the fastening mechanism preventing displacement of the protective blazer during a slide event.

6. The protective blazer of claim 1, further comprising a detachable gilet component attached to a front left breast panel and a front right breast panel of the protective blazer, wherein the protective blazer comprises an exposed chest region, the detachable gilet component covering the exposed chest and neck region of the protective blazer and providing wind protection to the wearer.

7. The protective blazer of claim 1, wherein the protective blazer comprises an exposed chest region, a pair of lapels, a front left breast panel, a front right breast panel, and one or more buttons configured for securing the front left breast panel and the front right breast panel to each other.

8. The protective blazer of claim 7, further comprising one or more of: a breast pocket, a sleeve vent, a pocket flap, a front dart, a collar, and a roll line.

9. The protective blazer of claim 7, wherein the exposed chest region is positioned between the pair of lapels.

10. The protective blazer of claim 1, wherein the abrasion resistant material comprises at least one of an aramid and a para-aramid.

11. The protective blazer of claim 1, wherein the at least one pocket comprises a back pocket, the back pocket centrally located in a back panel of the protective blazer and integrated with a back protector.

12. A motorcycle jacket, comprising:

an outer blazer component made of fabric, the outer blazer component including:

a left breast panel and a right breast panel, and a first fastening mechanism configured for securing the left breast panel and the right breast panel together across a torso of a wearer of the motorcycle jacket;

an inner component configured for providing an interface between the wearer and the motorcycle jacket;

a middle abrasion resistant component made from abrasion resistant material, the middle abrasion resistant component secures to and covers the outer blazer component of the motorcycle jacket with abrasion resistant material to reinforce the outer blazer component and protect the skin and torso of the wearer in a slide event or abrasion event during an accident, the middle abrasion resistant component being located between the inner component and the outer blazer component and forming a frame of the motorcycle jacket; and a second fastening mechanism comprising abrasion resistant material, the second fastening mechanism being positioned beneath the first fastening mechanism, wherein the second fastening mechanism directly attaches to a lower torso of the frame of the motorcycle jacket, and the second fastening mechanism is configured to separate a left lower torso side of a front of the motorcycle jacket from a right lower torso side of the front of the motorcycle jacket when unfastened, wherein the second fastening mechanism prevents displacement of the motorcycle jacket during an abrasion event.

13. The motorcycle jacket of claim 12, further comprising a first pair of pockets and a second pair of pockets, each pocket of the first pair of pockets being located in respective left and right shoulder areas of the motorcycle jacket, wherein an impact protector is positioned within each pocket of the first pair of pockets, and each pocket of the second pair of pockets being located in respective left and right elbow areas of the motorcycle jacket, wherein an impact protector is positioned within each pocket of the second pair of pockets.

14. The motorcycle jacket of claim 12, further comprising a pair of mesh panels, each mesh panel of the pair of mesh panels located at or near an armpit region of the motorcycle jacket for providing ventilation to the wearer, wherein the middle abrasion resistant component extends across both armpit regions of the motorcycle jacket, and the pair of mesh panels cut through each of the outer blazer component, the middle abrasion resistant component, and the inner component.

15. The motorcycle jacket of claim 12, further comprising a pair of gussets disposed between a back panel and a pair of shoulder panels of the motorcycle jacket, each gusset of the pair of gussets comprising textile fabric folded on top of itself and expandable for enabling freedom of movement of the arms of the wearer and configured to extend along a back of the motorcycle jacket.

16. The motorcycle jacket of claim 12, further comprising a detachable gilet component attached to the left breast panel and the right breast panel of the motorcycle jacket, wherein the motorcycle jacket comprises an exposed chest region, the detachable gilet component covering the exposed chest and neck region of the motorcycle jacket and providing wind protection to the wearer.

17. The motorcycle jacket of claim 16, wherein the detachable gilet component is configured to secure to the motorcycle jacket and the wearer by one or more zippers.

18. The motorcycle jacket of claim 16, wherein the detachable gilet component is further attached to the frame of the motorcycle jacket.

19. The motorcycle jacket of claim 12, further comprising a back protector pocket integrated centrally into a back panel of the motorcycle jacket, the back protector pocket being integrated with a back protector.

20. The motorcycle jacket of claim 12, further comprising an exposed chest region positioned between a pair of lapels.

* * * * *